United States Patent [19]

Bergstein et al.

[11] 4,063,403

[45] Dec. 20, 1977

[54] CARTON CLOSING AND SEALING APPARATUS

[75] Inventors: Frank David Bergstein, Cincinnati; Robert W. Nerenberg, Middletown; James H. Shiverdecker, Dayton, all of Ohio

[73] Assignee: Bergstein Packaging Trust, Middletown, Ohio

[21] Appl. No.: 716,551

[22] Filed: Aug. 23, 1976

[51] Int. Cl.[2] ..... B65B 51/10

[52] U.S. Cl. ..... 53/379; 53/373

[58] Field of Search ..... 53/378, 373, 379, 374, 53/375, 387, 124 B

[56] References Cited

U.S. PATENT DOCUMENTS

| | | | |
|---|---|---|---|
| 1,998,287 | 4/1935 | Pierson et al. | 53/387 X |
| 2,443,293 | 6/1948 | Bergstein et al. | 53/387 X |
| 2,585,335 | 2/1952 | McHale et al. | 53/378 |
| 2,669,815 | 2/1954 | Zinn, Jr. et al. | 53/375 X |
| 2,979,995 | 4/1961 | Bergstein et al. | 53/374 X |
| 3,241,291 | 3/1966 | Monroe et al. | 53/375 X |
| 3,405,505 | 10/1968 | Mistarz | 53/375 X |
| 3,451,194 | 6/1969 | Nerenberg et al. | 53/374 |
| 3,483,803 | 12/1969 | Back et al. | 53/374 X |
| 3,919,828 | 11/1975 | Zellman | 53/124 B |

*Primary Examiner*—Travis S. McGehee
*Assistant Examiner*—Horace M. Culver
*Attorney, Agent, or Firm*—Melville, Strasser, Foster & Hoffman

[57] ABSTRACT

Apparatus for automatically closing cartons having self-sealing reclosable top closures adapted, when closed, to lie within the confines of the carton bodies, the end closures having opposing pairs of sealing flaps adapted to be juxtaposed in face-to-face contacting relation, preferably with the mouths of carton liners interposed therebetween, the juxtaposed sealing flaps and liner mouths being displaceable downwardly to close the cartons and thereafter displaceable upwardly to reopen the cartons, the apparatus comprising a series of continuously moving carriages which receive and advance the openended cartons in a path of travel, the cartons being first acted upon by sets of folding fingers which concurrently infold the leading and trailing end closure flaps and the projecting ends of the liners, whereupon sweep means act to juxtapose the opposing pairs of sealing flaps with the liners interposed therebetween. If desired, heat sealing means may be provided to seal together the juxtaposed portions of the liners lying between the sealing flaps; and if the sealing flaps are provided with foldable extensions, additional sweep means are provided to infold the extensions. Thereafter the closed but extended sealing flaps are sequentially engaged by tucking heads mounted on a rotatable turret, the tucking heads engaging and displacing the extended sealing flaps downwardly within the carton bodies to complete the formation of the end closures.

16 Claims, 10 Drawing Figures

CARTON CLOSING AND SEALING APPARATUS

BACKGROUND OF THE INVENTION

This invention relates to packaging apparatus and has to do more particularly with packaging apparatus for closing and sealing the ends of rectangular cartons as they are conveyed in a path of travel by a series of carriages to which the open-ended cartons are sequentially presented, and from which the cartons are sequentially discharged following a series of manipulative steps during which the cartons are closed and sealed.

The present invention relates to a modification and adaptation of the type of sealing apparatus disclosed in U.S. Pat. No. 3,483,803 and those which preceded it wherein lined carton structures to be closed and sealed are placed in carriages which advance the cartons through a series of operating stations at which the extending liner mouths and the end closure flaps arre folded and sealed as the cartons advance in the closed loop path of travel. Such apparatus was specifically designed to handle conventional lined cartons, that is, lined cartons having conventional seal end closure flaps adapted to be sequentially infolded and adhered together to form the end closure. Where the cartons included tubular liners, the mouths of the liners were engaged by sets of fingers which entered the liners and expanded to bring the liners to a flattened and elongated position, whereupon the flattened mouths of the liners were sealed together and folded over, followed by the infolding of the leading and trailing end closure flaps, the application of adhesive and the infolding of the remaining pair of end closure flaps.

The present invention relates to the closing and sealing of cartons having a unique self-sealing reclosable end closure of the type disclosed in co-pending U.S. application for Letters Patent Ser. No. 644,303 filed Dec. 24, 1975, now U.S. Pat. No. 4,032,060, and entitled "Carton with Self-Sealing Reclosable End Closure", and specifically to apparatus designed to automatically close and seal cartons having self-sealing reclosable end closures as disclosed in the aforesaid co-pending application.

SUMMARY OF THE INVENTION

The present invention relates to apparatus for closing and sealing cartons having a self-sealing reclosable end closure comprising a pair of opposing end closure flaps hingedly connected to the end edges of the carton side walls, the end closure flaps having a width somewhat greater than one-half the width of the carton end walls, together with a pair of mating sealing flaps hingedly connected to the outermost side edges of the pair of opposing end closure flaps, the sealing flaps being adapted to be juxtaposed in face-to-face contact in parallel relation to the carton side walls, whereupon they are displaceable downwardly to lie within the confines of the carton body with the opposing pair of closure flaps extending downwardly and inwardly within the carton to bias the sealing flaps into tight engagement with each other. In their preferred embodiment, the cartons have tubular liners the extending mouths of which are adapted to be infolded at their opposite end edges and interposed between the opposing sealing flaps. If desired, the opposite sides of the sealing flaps may be lightly sealed together to form a seal which may be broken when the mouths of the liners are reopened, and/or one of the opposing sealing flaps may be provided with a foldable extension, with the liner mouth extended to coincide with the extension, so that upon juxtaposition of the opposing sealing flaps, the extension and the coinciding outermost portions of the liner may be folded over the upper edge of the remaining sealing flap to form a tight end closure. In either event, following juxtaposition of the opposing sealing flaps and the folding over of the extension, if one is present, the entire end closure is displaced downwardly so as to lie within the confines of the carton body, the remaining pair of carton body walls being provided with relatively narrow end closure flaps which, when displaced inwardly, abut against and lock the sealing flaps in the closed position.

The present invention provides apparatus for continuously and automatically closing carton structures of the character just described. To this end, the invention utilizes packaging apparatus having a plurality of carton conveying carriages which move in a closed-loop path of travel between a carton receiving station and a carton discharging station. The cartons are received by the carriages with their open top closures uppermost, the cartons being advanced in a path of travel with their opposing end closure and sealing flaps extending parallel to their path of travel, thereby constituting the narrow closure flaps as the leading and trailing flaps.

In accordance with the invention, the cartons are first acted upon by sets of fingers which contact and infold the leading and trailing closure flaps and at the same time infold the leading and trailing ends of the liner mouths, the liner mouths being reversely folded to form opposing pleats or bellows, the mouths of the liners thus lying wholly within the confines of the opposing sealing flaps. Sweep means then engage the sealing flaps and displace them inwardly into face-to-face contacting relation, with the folded mouths of the liners interposed therebetween. If the liners are to be heat sealed together for added proofing, heat sealing means are provided to contact the sealing flaps, the sealing means applying sealing heat and pressure to the liners through the overlying sealing flaps.

If the cartons are provided with foldable flap extensions, additional sweep means are provided to fold over the extensions and the coinciding marginal edges of the liners, whereupon the folded but still extended end closures are advanced for sequential engagement by tucking heads mounted on a turret rotating in timed relation to the advancing carton, the tucking heads being adapted to engage the uppermost edges of the end closures and displace them downwardly within the carton bodies to complete the end closures, whereupon the tucking heads are withdrawn and the closed and sealed cartons advanced to a discharge station where they are removed from the apparatus.

DESCRIPTION OF THE PREFERRED EMBODIMENT

Figure 1:
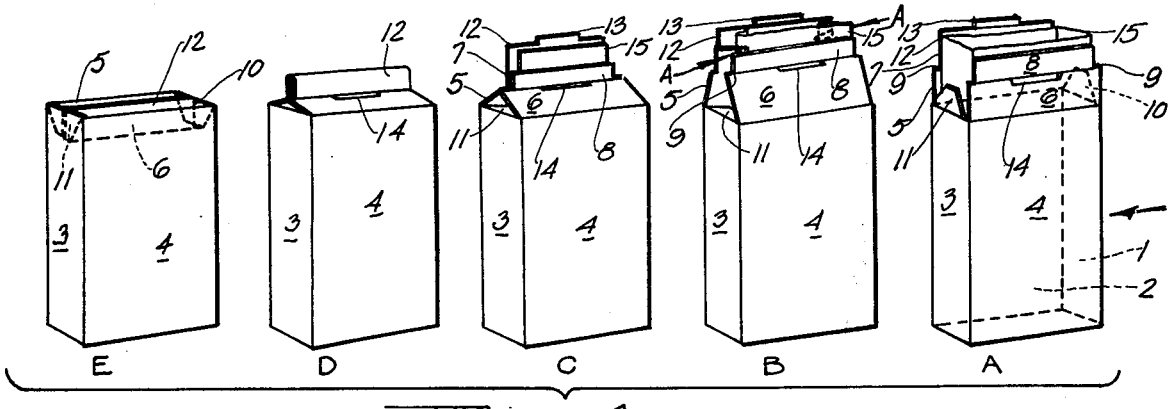
FIGS. 1A through 1F are fragmentary perspective views illustrating successive stages of the closing and sealing of carton structures utilizing apparatus in accordance with the present invention.

Referring first to FIGS. 1a through 1F which illustrate successive stages in the closing and sealing of cartons provided with self-sealing reclosable end closures, the carton comprises enclosing body walls 1, 2, 3 and 4 hingedly connected in the order named to provide a tubular body. The top closure comprises a first opposing pair of closure flaps 5 and 6 hingedly connected to the uppermost ends of body walls 2 and 4, resepctively, throughout their full lengths. The width of each of the closure flaps 5 and 6 is somewhat greater than one-half the width of the adjoining carton body walls 1 and 3, but less than the full width of body walls 1 and 3. Sealing flaps 7 and 8 are hingedly connected to the opposite side edge of closure flaps 5 and 6, respectively, the sealing flaps preferably being of a length slightly less than the length of closure flaps 5 and 6 so as to define shoulders 9 at the juncture of their opposite end edges with the underlying end closure flaps. Closure flaps 10 and 11, which are preferably of truncated triangular configuration, are hingedly connected to the upper ends of body walls 1 and 3, respectively, the closure flaps 10 and 11 preferably having a width slightly less than the width of closure flaps 5 and 6. In the embodiment illustrated, a flap extension 12 is hingedly connected to the uppermost edge of sealing flap 7, the extension carrying a shallow tongue 13 adapted, when the carton is closed, to engage in slot 14 formed in flap 6 at its juncture with sealing flap 8. A tubular liner 15 is enclosed within the carton body walls, the liner projecting upwardly so that its uppermost free edge coincides with the uppermost edge of flap extension 12. Preferably, the opposite side of the liner will be adhesively secured to closure flaps 5 and 6 as well as to sealing flaps 7 and 8, and also to flap extension 12, although the opposite ends of the liner will be free from attachment to the narrow closure flaps 10 and 11.

It will be understood that the carton body may have any type of end closure at its opposite end, usually a conventional seal end closure, and while the opposite end of the carton, including the liner, may be first sealed and the contents introduced into the carton prior to the closing of the self-sealing end closure, it is preferred to first close the reclosable end closure followed by removal of the carton from the closing and sealing apparatus, whereupon the carton is inverted and filled from its bottom end, followed by the closing and sealing of the bottom closure in conventional fashion. Such procedure avoids possible interference of the contents of the carton with the inward displacement of the reclosable flaps which in the closed position lie within the confines of the carton body walls.

Referring next to FIG. 1B, the initial step in the formation of the end closure comprises the infolding of the triangular flaps 10 and 11, together with the infolding of the opposite end portions of the projecting liner 15, such folding movement being indicated by the Arrows A. As will be explained hereinafter, such folding movement is accomplished by sets of folding fingers which engage and fold the flaps and liner ends inwardly and then retract. In the event the carton is unlined, the folding fingers will simply fold the triangular flaps 10 and 11 inwardly in preparation for the juxtaposition of the sealing flaps 7 and 8 accompanied by the partial infolding of underlying end closure flaps 5 and 6. FIG. 1C illustrates the end closure with the sealing flaps 7 and 8 juxtaposed and the underlying closure flaps 5 and 6 folded to a substantially horizontal position. In this connection, each of the closure flaps 5 and 6 is somewhat wider than one-half the width of the body walls 1 and 3, and consequently the opposing body walls 2 and 4 will be flexed outwardly to accommodate the closure flaps 5 and 6 as they pass through the horizontal position and subsequently enter the mouth of the carton. However, prior to the downward displacement of the sets of closure and sealing flaps, the opposing sides of the liner mouth may be sealed together, preferably with a relatively light bond which may be readily broken when it is decided to open the carton. Preferably, sealing bars will be positioned to contact the outermost surfaces of the sealing flaps 7 and 8, the sealing bars providing sufficient heat and pressure to heat seal the areas of the liner lying between the sealing flaps. While the extreme marginal edges of the liner could be sealed in the area of flap extension 12, sealing in the areas of the sealing flaps is preferred in that the sealing flaps, to which the liner is adhesively secured, may be used to assist in breaking the seal when it is desired to reopen the carton.

If the carton is provided with a flap extension 12, it is next infolded to the position illustrated in FIG. 1D, in which position the flap extension, together with the extending portion of the liner will be folded over the upper edge of sealing flap 8 and the tongue 13 inserted in slot 14. The carton is now in condition for final closing movement, which comprises the downward displacement of the sealing flaps 8 and 9, together with extensions 13, to the position illustrated in FIG. 1E wherein the end closure lies wholly within the confines of the carton body walls 1 through 4. The downward displacement of the sealing flaps also serves to displace the underlying closure flaps 5 and 6 downwardly so that they will be inclined downwardly and inwardly, and it will be evident that the natural tendency of the folded flaps will be to unfold due to the resiliency of the box board, and such tendency to unfold serves to bias the juxtaposed sealing flaps 7 and 8 into tight clamping engagement with the liner therebetween. Thus, an effective seal can be formed even though the mouth of the liner is not heat sealed to itself or even absent the folded over flap extension 12 which further seals the liner by reason of its folded over condition. Consequently, varying degrees of proofness can be achieved depending upon the nature of the contents being packaged. It also may be pointed out that when the closure flaps 5 and 6 reach their fully closed position, the shoulders 9 at their opposite ends engage beneath the truncated end edges of the triangular flaps 10 and 11, thereby locking the closure flaps in the closed position. When it is desired to open the end closure, upward movement of the sealing flaps 7 and 8 will cause opposing closure flaps 5 and 6 to move upwardly, and in so doing the triangular flaps 10 and 11 will also move upwardly and will flex sufficiently to release the shoulders 9 as the closure flaps reassume their extended positions, whereupon the sealing flaps may be displaced outwardly to open the carton for the discharge of its contents.

Figure 2:
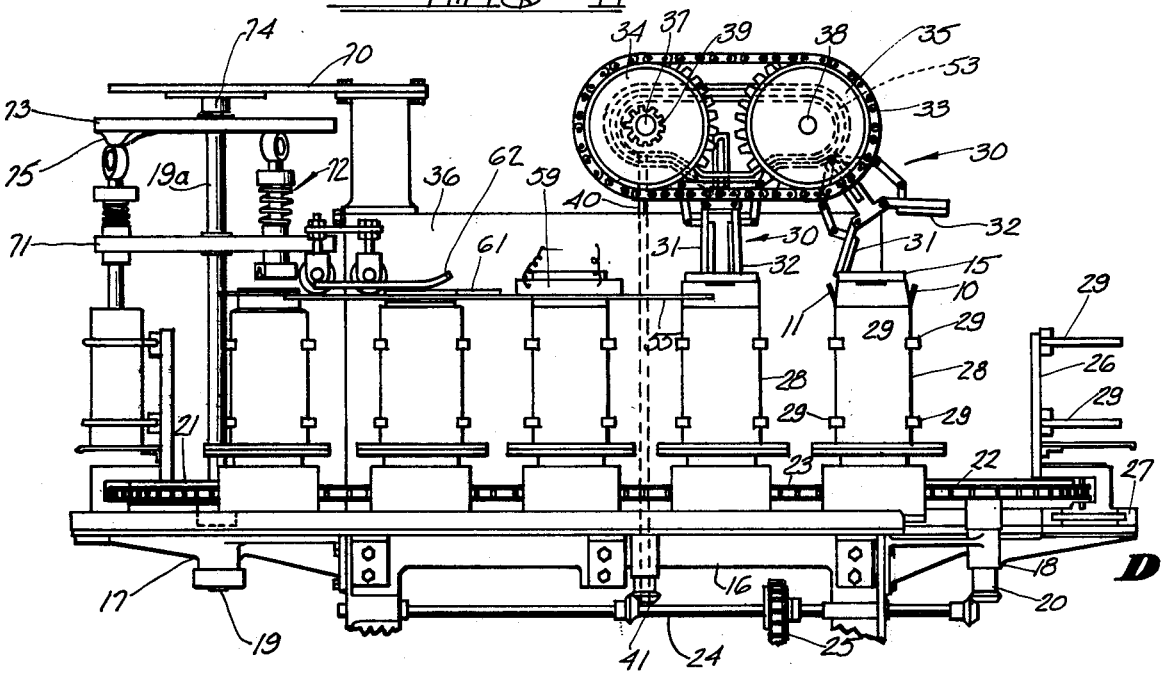
FIG. 2 is a side elevation of carton closing and sealing apparatus embodying the present invention.

With the construction of the carton end closure now in mind, reference is next made to FIG. 2 of the drawings for an understanding of the apparatus utilized to close and seal the cartons. The basic apparatus is of the type disclosed in the aforementioned U.S. Pat. No. 3,483,803 and comprises a main frame 16 mounting bearings 17 and 18 adjacent its opposite ends in which vertically disposed shafts 19 and 20 are rotatably journaled, the shafts mounting horizontally disposed sprockets 21 and 22 about which an endless conveyor chain 23 moves in a horizontal path of travel. Driving power is supplied by the sprocket 22 which is driven through suitable gearing from a drive shaft 24 connected by means of a driving sprocket 25 to a suitable source of power, such as an electric motor, which is not shown. The conveyor chain 23 carries a series of spaced apart carriages 26 which are guided in proper alignment about the path of travel of the conveyor chain by channeled guide members generally indicated at 27.

Figure 3:
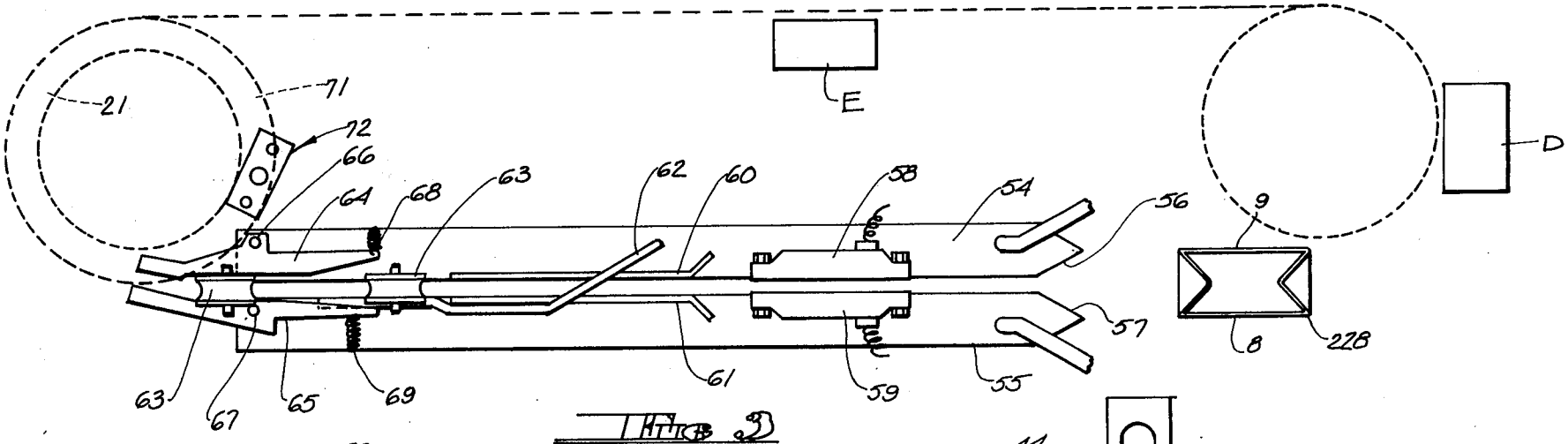
FIG. 3 is a fragmentary plan view of the apparatus illustrated in FIG. 2.

Each of the carriages 26 is adapted to receive and convey a carton 28 which will be of the construction previously described, the cartons being presented to the carriages at one end of the apparatus, as at the delivery station D indicated in FIGS. 2 and 3. Each of the carriages is provided with coacting pairs of locking arms 29 which, upon presentation of a carton to the carriage, engage the carton body walls and secure it to the carriage. The cartons will be positioned on the carriages with body walls 2 rearmost, so that body wall 3 is constituted the leading wall in their path of travel and body wall 1 is constituted the trailing body wall.

As each carton 28 is advanced by its carriage, the triangular end closure flaps 10 and 11, together with the upstanding portion of liner 15, will be contacted by folding devices, indicated generally at 30, each of the folding devices having a pair of folding fingers 31 and 32 which contact and infold both the leading and trailing end closure flaps and the opposite end edges of the liner 15.

The folding devices 30 are mounted on a conveyor chain 33 adapted to pass around sprockets 34 and 35 mounted on a vertical support 36 extending upwardly from the main frame 16, the sprockets 34 and 35 being rotatably journaled on shafts 37 and 38, and shaft 37 being driven through gear means 39 operatively connected to drive shaft 40 which, in turn, is connected through gear means 41 to main drive shaft 24.

Figure 5:
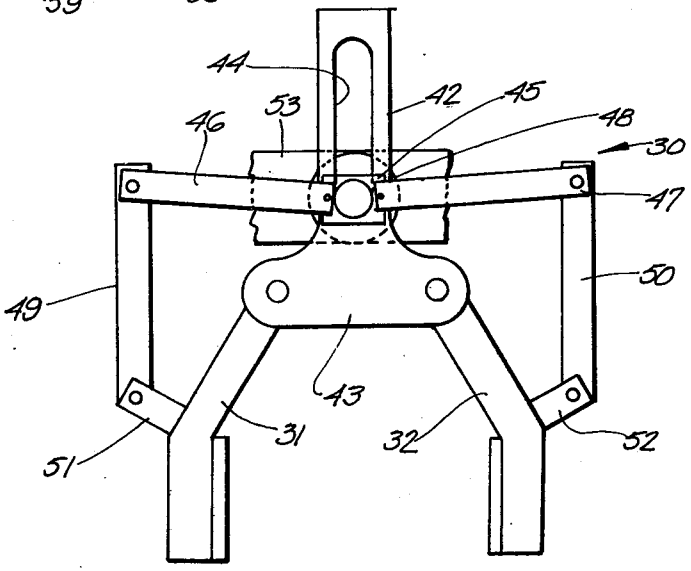
FIG. 5 is a fragmentary elevational view similar to FIG. 4 illustrating the folding fingers in their closed position.
Figure 4:
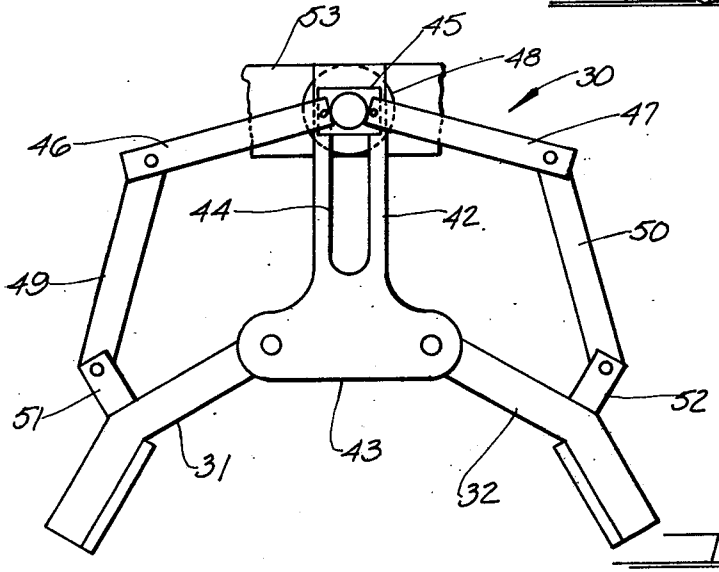
FIG. 4 is an enlarged fragmentary elevational view of a set of the folding fingers in their open position.

Referring next to FIGS. 4 and 5, each of the folding devices 30 has an elongated body 42 having an enlarged lower end 43 to which the folding fingers 31 and 32 are pivotally connected for movement from the expanded position illustrated in FIG. 4 to the contracted position illustrated in FIG. 5. The elongated body 42 is pinned to the conveyor chain 33 for movement therewith, the body having an elongated slot 44 therein which slidably mounts a fitting 45. The fitting extends through the slot and has a pair of links 46 and 47 pivotally connected at one end to the near side of the fitting; and on its opposite side the fitting rotatably mounts a cam roller 48. Additional link members 49 and 50 are pivotally connected to the opposite ends of links 46 and 47, and the opposite ends of links 49 and 50 are pivotally connected to ears 51 and 52 projecting laterally from the folding fingers 31 and 32, respectively. With this arrangement, when the fitting 45 is moved upwardly in slot 44, it acts through links 46 and 49 to elevate or extend folding finger 31; and similarly, links 47 and 50 act to extend folding finger 32, the parts assuming the fully extended position illustrated in FIG. 4 when fitting 45 reaches the uppermost end of slot 44. As the fitting moves downwardly within the slot, the sets of links will displace the folding arms 31 and 32 inwardly to the closed or folding position illustrated in FIG. 5, in which position the folding fingers will contact and infold the leading and trailing closure flaps and the opposite ends of the liner mouth.

Referring again to FIG. 2, opening and closing movement of the sets of fingers is controlled by the continuous cam track 53 mounted on the far side of sprockets 34 and 35, the cam track receiving the cam rollers 48 of each of the folding devices 30. As will be apparent from FIG. 2, the cam track 53 is configured to normally maintain the sets of folding fingers 31 and 32 in their extended or open positions, the folding fingers being closed only as one of the folding devices moves into vertical alignment with an underlying carriage, whereupon the cam track drops so as to move the fitting 45 downwardly, thereby moving the folding fingers inwardly to their closed or folding position. Thereafter, the cam track rises and the folding fingers will expand and disengage the liner and the now infolded triangular closure flaps. It will be understood that the folding members 30 will travel in timed relation to the movement of the underlying carriages 26 and the open ended cartons being conveyed by the carriages.

Just as each set of folding fingers commences its opening or expanding movement following the infolding operation, the advancing carton passes between an opposing pair of folding plates 54 and 55 which are best seen in FIG. 3. The folding plates are positioned to engage the opposing sealing flaps 7 and 8 just as the folding fingers commence their expanding movement, the plates having tapered leading edges 56 and 57 which engage and displace the sealing flaps inwardly toward each other as they pass between the folding plates. In addition, the undersurfaces of the folding plates ride over and hold the underlying end closure flaps 5 and 6 in partially infolded condition, and additionally serve to prevent the previously infolded triangular closure flaps 10 and 11 from unfolding. If the opposite sides of the liner are to be heat sealed together, the now juxtaposed sealing flaps are passed between a pair of closely spaced apart heating elements 58 and 59 which may be conveniently mounted on the folding plates, the heating elements serving to seal together the juxtaposed and flattened walls of the liner, the sealing bars applying heat and pressure to the liner through the sealing flaps to provide a relatively light bond which may be readily broken when the carton is opened.

Upon passage beyond the heating elements, the sealing flaps pass between a pair of vertically disposed fins 60 and 61 which have their uppermost edges positioned to coincide with the uppermost edges of the sealing flaps. A sweep 62 is positioned to engage the upstanding extension 12 on sealing flap 7 and infold it in the direction of opposing sealing flap 8, the upper edge of fin 61 serving as a folding edge about which the flap extension may be folded. Thereafter, the folded upper edge of the end closure may be contacted by one or more grooved rollers 63 which maintain the folded upper edge of the end closure at the proper height as the carton is advanced toward the tucking station at which the end closure is displaced downwardly to lie within the confines of the carton body.

Figure 6:
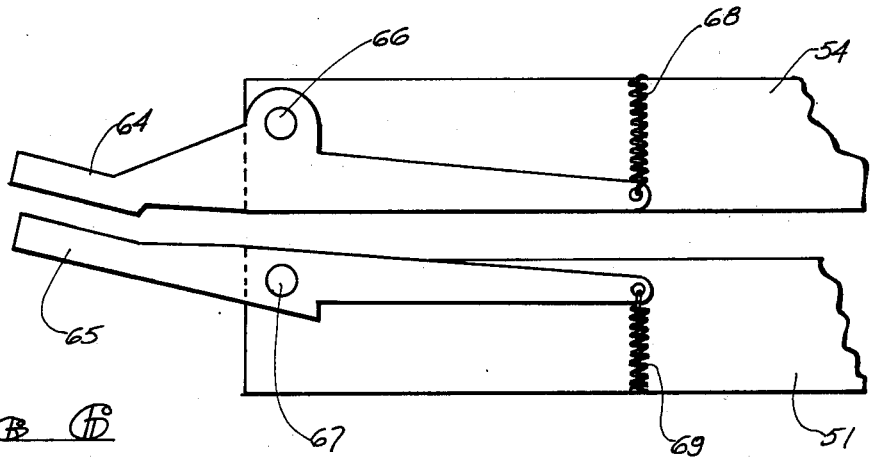
FIG. 6 is an enlarged fragmentary plan view of the spring biased guide members which position the closed but extended end closures for contact by the tucking heads.

To assist in bringing the cartons and their end closure into registry with the mechanism which performs the tucking operation, a coacting pair of elongated guide arms 64 and 65 is provided at the trailing ends of the folding plates 54 and 55. As best seen in FIG. 6, these guide arms are pivotally connected to the trailing ends of the folding plates at intermediate pivot points 66 and 67, respectively, and guide arms are provided at their leading ends with springs 68 and 69 which resiliently bias the guide arms so that they may move relative to each other. The guide arms project rearwardly from the folding plates and are positioned to align the end closures of the advancing cartons with the tucking heads. However, due to the fact that the tucking heads travel in a circular path, some flexing of the end closures will be encountered as they are engaged by the tucking heads, and the resiliently mounted guide arms will accommodate any such flexing movement.

Referring again to FIG. 2, the shaft 19, which drives conveyor sprocket 21, has an upwardly projecting extension 19*a* which, at its uppermost end, is rotatably journaled in a bracket 70 forming a part of the machine frame. A rotatable turret 71 is mounted on shaft extension 19*a* for rotation therewith, the turret mounting a series of equally spaced apart tucking heads, indicated generally at 72, which perform the tucking operation. A cam plate 73 overlies the rotatable turret 71 and is fixedly secured to the bracket 70 by means of a collar 74. The plate 73 mounts a cam 75 which sequentially actuates the tucking head as the turret rotates in timed relation to the advancing cartons.

Figure 7:
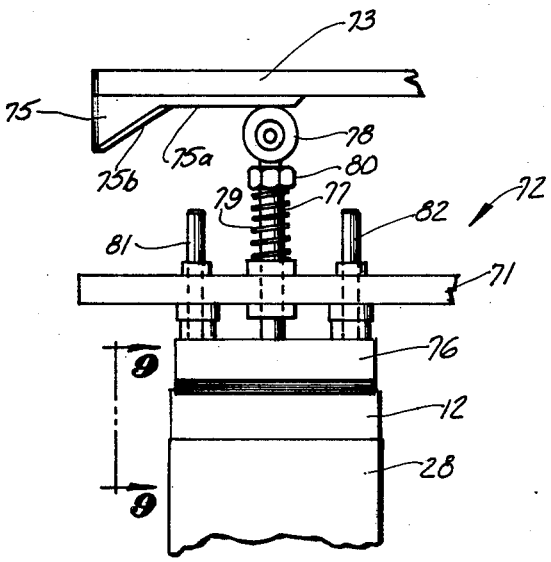
FIG. 7 is an enlarged fragmentary elevational view of a tucking head as it receives a closed but still extended end closure.
Figure 8:
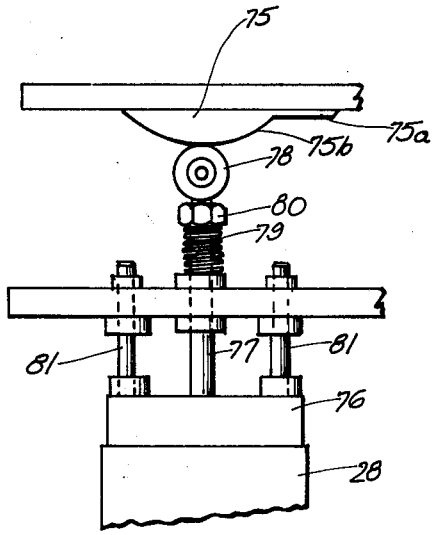
FIG. 8 is a fragmentary elevational view similar to FIG. 7 showing the tucking head in its fully extended position.
Figure 9:
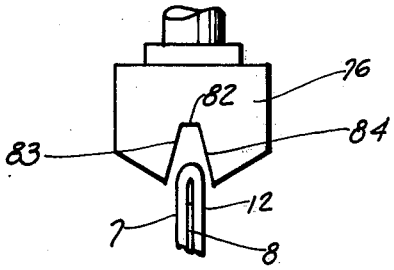
FIG. 9 is an enlarged vertical sectional view taken along the line 9—9 of FIG. 7.

Referring next to FIG. 7, each of the tucking heads comprises a tucking bar 76 mounted on a plunger 77 which extends upwardly through rotatable turret 71, the plunger having a cam roller 78 at its uppermost end. A spring 79 extends between the turret and a collar 80 secured to the plunger adjacent it uppermost end, the spring 79 serving to normally bias the plunger to its uppermost position. The tucking bar 76 also mounts a pair of upwardly projecting guide pins 81 and 82 which extend through the turret 71 and are slidably received in suitable fittings As seen in FIG. 9, the tuck bar has a channel 82 in its undersurface having inclined wall surfaces 83 and 84 adapted to receive and engage the upper marginal surfaces of the end closure as the tucking bar comes into registry with the end closure of an advancing carton. As will be apparent from FIG. 3, the path of travel of the cartons is tangential with respect to the rotatable turret 71, and the timing of the parts is such that one of the tucking heads 72 will be rotated into vertical alignment with an advancing carton as the carton reaches a tangential position with respect to the turret. Thereafter, the cartons and the turret will travel in a circular path of travel as the carton carrying carriages travel around the sprocket 21, and it is during this portion of their travel that the tucking operation is performed. Preferably, however, as the cartons reach a tangential position with respect to the rotating turret, there will be a slight rise in cam 75, indicated at 75*a*, which deflects the tucking bar 76 downwardly by a distance sufficient to permit the uppermost edges of the sealing flaps to enter channel 84 in the undersurface of the tucking bar. The mouth of the channel 82 is sufficiently wide to receive the sealing flaps and, as previously pointed out, the resiliently mounted guide arms 64 and 65 permit flexing movement of the end closure to permit it to accommodate to the tucking bar. Thereafter, the main rise 75*b* of cam 75 will displace the plunger 77 downwardly to the fully extended position illustrated in FIG. 8, in which the end closure is displaced downwardly within the confines of the body walls of the underlying carton 28, the carton thus assuming the fully closed position illustrated in FIG. 1E. The cam 75 then drops off so that the plunger 77 may return the tucking bar to its uppermost position under the influence of spring 79. Thereafter, as each carton continues its travel along the opposite side of the apparatus, it will pass a discharge station, diagrammatically indicated at E, where the locking arms 29 of the carriages 26 will be opened and the cartons discharged from the apparatus. Thereafter, the empty carriages will return to the delivery station D to receive additional cartons to be closed and filled.

Figure 10:
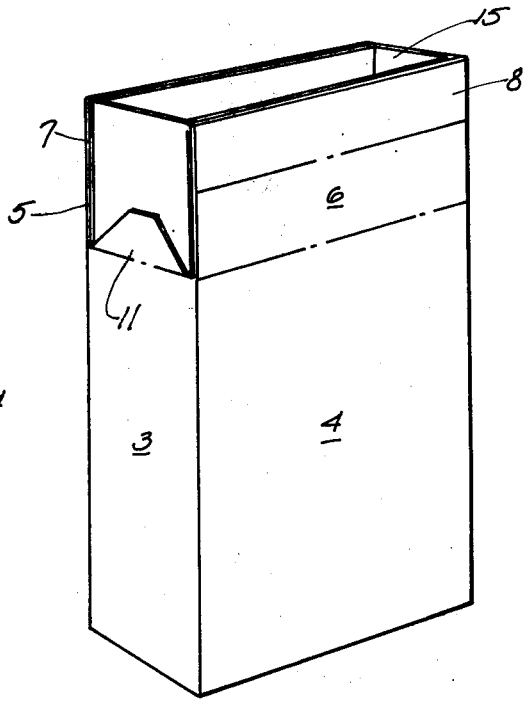
FIG. 10 is a fragmentary perspective view illustrating a modified end closure construction which may be closed and sealed utilizing the apparatus of the present invention.

As should now be evident, the instant invention provides apparatus for automatically closing lined cartons having self-sealing reclosable end closures of the character described. In addition to closing and sealing the type of end closure illustrated in FIGS. 1A through F, which includes a folded over flap extension, the apparatus is also capable of closing simplified versions of the carton structures such as that illustrated in FIG. 10, the flap extension 12 has been eliminated, in which event the sweep 62 is not required. Unlined cartons also may be closed using the apparatus, in which event the folding fingers 31 and 32 simply infold the leading and trailing triangular closure flaps. The use of the heat sealing elements 58 and 59 is also optional, depending upon whether or not the liner is to be sealed.

While various modifications of the invention have already been set forth, other modifications will undoubtedly occur to the worker in the art upon reading this specification, and it is not intended that the invention be limited other than in the manner set forth in the claims which follow.

The embodiments of the invention in which an exclusive property or privilege is claimed are defined as follows:

1. Apparatus for closing cartons having enclosing body walls and an end closure comprising at least an opposing pair of end closure flaps having sealing flaps hingedly connected to their outermost side edges, means for advancing the cartons in a path of travel with their said end closure flaps initially projecting upwardly in prolongation of the body walls to which they are hingedly connected and with the said end closure flaps extending lengthwise with respect to the path of travel of the cartons, means for displacing the sealing flaps inwardly to juxtapose them in face-to-face relation, including means for maintaining the sealing flaps in juxtaposed relation as they are advanced, a tucking station, a tucking head at said tucking station, means mounting said tucking head above the path of travel of the cartons, said tucking head mounting a tucking bar having an elongated channel in its undersurface adapted, when the tucking bar is displaced downwardly, to engage the juxtaposed sealing flaps and deflect them downwardly within the confines of the carton bodies, means for displacing said tucking bar downwardly in timed relation to the movement of the cartons through said tucking station, and displaceable guide arms at the trailing end of the means for maintaining the sealing flaps in juxtaposed relation, said guide arms being positioned to guide the juxtaposed sealing flaps beneath said tucking head in alignment with said tucking bar, said guide arms being displaceable in the event the sealing flaps are flexed by the tucking bar as an incident of the engagement of the sealing flaps by the channel in the sealing bar.

2. The apparatus claimed in claim 1 wherein the means mounting said tucking head comprises a rotatable turret, and means for rotating said turret in timed relation to the movement of the cartons in their path of travel.

3. The apparatus claimed in claim 2 wherein said tucking bar is mounted on a vertically movable plunger, and wherein the means for displacing said tucking bar downwardly comprises cam means engageable by said plunger.

4. The apparatus claimed in claim 3 wherein said cam means is mounted on a fixed support overlying said rotatable turret, wherein said plunger extends upwardly through said turret, and wherein said plunger mounts a cam roller at its uppermost end engageable with said cam means.

5. The apparatus claimed in claim 4 including spring means normally biasing said plunger to its uppermost position.

6. The apparatus claimed in claim 5 wherein said turret mounts a plurality of tucking heads of like construction lying at spaced apart intervals, and wherein the plungers mounting said tucking bars are positioned to successively engage said cam means as said tucking heads rotate through said tucking station.

7. The apparatus claimed in claimed 1 wherein the means for displacing said sealing flaps inwardly comprises an opposing pair of folding plates lying on opposite sides of the path of travel of the advancing cartons.

8. The apparatus claimed in claim 7 wherein said guide arms are pivotally mounted and include spring means resiliently biasing said guide arms in the direction of a carton end closure passing therebetween, whereby said guide arms may be displaced against the compression of their biasing springs in the event the sealing flaps are flexed by the tucking bar upon contact therewith.

9. The apparatus claimed in claim 7 including heat sealing means mounted on said folding plates and positioned to contact the sealing flaps of each carton subsequent to their inward displacement by said folding plates.

10. The apparatus claimed in claim 7 including sweep means associated with said folding plates, said sweep means being positioned to infold a flap extension hingedly connected to the outermost side edge of one of the sealing flaps.

11. The apparatus claimed in claim 10 including fin means mounted on at least one of said folding plates and extending lengthwise thereof in the area of said sweep means, said fin means being positioned to define a folding edge over which the folding of the flap extension by said sweep means may be enforced.

12. The apparatus claimed in claim 1 including a set of folding fingers overlying the path of travel of the cartons in advance of the means for displacing the sealing flaps inwardly, said folding fingers being pivotably mounted at their upper ends for movement from an extended position to a closed position and return, and linkage means pivotally connected to said folding fingers intermediate their ends for moving said folding fingers from one position to the other in timed relation to the movement of the cartons in their path of travel, said folding fingers being positioned to engage and infold upwardly projecting closure flaps hingedly connected to the leading and trailing carton body walls as well as fold inwardly the leading and trailing sides of a tubular liner projecting upwardly from the carton bodies.

13. The apparatus claimed in claim 12 including means mounting said folding fingers for traveling movement with the advancing cartons.

14. The apparatus claimed in claim 13 wherein the means mounting said folding fingers for traveling movement comprise a spaced apart pair of sprockets interconnected by a closed loop conveyor chain, the said folding fingers being connected to said conveyor chain for movement therewith.

15. The apparatus claimed in claim 14 wherein the means for moving the folding fingers from an expanded position to a closed position and returned comprises a cam track adjacent the path of traveling movement of said folding fingers, and cam roller means operatively connected to said folding fingers, said cam roller means being in engagement with said cam track, and said linkage means being pivotally connected to said cam roller means, whereby said cam roller means controls the opening and closing movement of said folding fingers.

16. The apparatus claimed in claim 15 wherein a plurality of like sets of said folding fingers are mounted on said conveyor chain at spaced apart intervals, said sets of folding fingers being positioned to engage the closure flaps and the liners of successive cartons being advanced in their said path of travel.

* * * * *